US007032582B2

(12) United States Patent
Asano et al.

(10) Patent No.: US 7,032,582 B2
(45) **Date of Patent: *Apr. 25, 2006**

(54) INJECTION CONTROL SYSTEM OF INTERNAL COMBUSTION ENGINE

(75) Inventors: Masahiro Asano, Kariya (JP); Eiji Takemoto, Obu (JP)

(73) Assignee: Denso Corporation, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/980,807

(22) Filed: Nov. 4, 2004

(65) Prior Publication Data

US 2005/0092300 A1 May 5, 2005

(30) Foreign Application Priority Data

Nov. 5, 2003 (JP) ..... 2003-375487

(51) Int. Cl.
*F02D 41/00* (2006.01)

(52) U.S. Cl. ..... 123/674; 123/436

(58) Field of Classification Search ..... 123/674, 123/436, 435, 295, 305, 480
See application file for complete search history.

(56) References Cited

U.S. PATENT DOCUMENTS 4,590,907 A 5/1986 Tsukamoto et al.
4,667,634 A 5/1987 Matsumura et al.
4,715,344 A * 12/1987 Tomisawa ..... 123/339.12
4,729,359 A * 3/1988 Tomisawa et al. ..... 123/339.12
4,870,938 A * 10/1989 Nakaniwa ..... 123/674
4,881,505 A * 11/1989 Tomisawa ..... 123/480
4,977,881 A * 12/1990 Abe et al. ..... 123/674
5,243,951 A * 9/1993 Nakaniwa ..... 123/674
5,297,046 A * 3/1994 Nakaniwa ..... 701/106
5,425,349 A * 6/1995 Nagaishi et al. ..... 123/674
5,517,970 A * 5/1996 Okada et al. ..... 123/436
5,598,702 A * 2/1997 Uchikawa ..... 60/274
5,638,800 A * 6/1997 Furuya et al. ..... 123/674
5,809,969 A 9/1998 Fiaschette et al.
5,901,684 A 5/1999 Fiaschetti et al.
5,921,226 A * 7/1999 Toyohara et al. ..... 123/674
6,755,176 B1 * 6/2004 Takeuchi et al. ..... 123/299
6,907,861 B1 * 6/2005 Asano et al. ..... 123/395
2003/0131823 A1 7/2003 Asakawa
2003/0164166 A1 9/2003 Takeuchi et al.
2004/0267433 A1 12/2004 Asano et al.

FOREIGN PATENT DOCUMENTS

JP 62-23552 1/1987

* cited by examiner

*Primary Examiner*—Mahmoud Gimie
(74) *Attorney, Agent, or Firm*—Nixon & Vanderhye P.C.

(57) ABSTRACT

An electronic control unit (ECU) of an injection control system of an internal combustion engine measures an engine rotation speed in a period from a time point when an exhaust valve opens to a time point when a top dead center of a next cylinder is detected after a single injection is performed. The ECU calculates a rotation speed fluctuation caused by the single injection based on the engine rotation speed. The engine rotation speed provided immediately after the single injection is measured after a cylinder pressure increased by the single injection decreases to substantially the same level as the cylinder pressure provided in the case where the single injection is not performed. Therefore, the rotation speed fluctuation corresponding to torque generated by the single injection can be measured accurately.

7 Claims, 5 Drawing Sheets

INJECTION CONTROL SYSTEM OF INTERNAL COMBUSTION ENGINE

CROSS REFERENCE TO RELATED APPLICATION

This application is based on and incorporates herein by reference Japanese Patent Application No. 2003-375487 filed on Nov. 5, 2003.

BACKGROUND OF THE INVENTION

1. Field of the Invention

The present invention relates to an injection control system of an internal combustion engine for performing a learning operation of an injection quantity.

2. Description of Related Art

A certain controlling method (an injection quantity learning operation) known as a method of controlling an injection quantity of a gasoline engine or a diesel engine estimates the injection quantity (or torque generated by injection) based on a fluctuation of an engine rotation speed, which is caused by combusting the injected fuel, to correct the injection quantity.

A publicly known calculating method disclosed in U.S. Pat. No. 4,667,634 or Unexamined Japanese Patent Application Publication No. H07-59911 calculates the fluctuation of the engine rotation speed (a rotation speed fluctuation δ) by comparing a rotation speed ωt at a top dead center (TDC), which is sensed at a time point t10 in FIG. 6, with a rotation speed ωc at a crank angle of 90° after the TDC (ATDC 90° CA), which is sensed at a time point t11, as shown by a solid line "f" in FIG. 6. Alternatively, the rotation speed fluctuation δ is calculated by comparing the rotation speed ωc at the ATDC 90° CA with a predetermined value. Engine rotation speeds ωa, ωb, ωc, ωd are respectively measured at time points t3, t8, t11, t14, where the crank angle is ATDC 90°. For instance, the rotation speed ωa at the time point t3 is calculated from a period S1 from a time point t2 to a time point t4. In FIG. 6, a period "A" corresponds to an intake stroke of a first cylinder and a compression stroke of a second cylinder. A period "B" corresponds to a compression stroke of the first cylinder. A period "C" corresponds to an expansion stroke of the first cylinder and a compression stroke of a third cylinder. A period "D" corresponds to an exhaustion stroke of the first cylinder and a compression stroke of a fourth cylinder. In FIG. 6, a solid line "a" or a broken line "a'" represents a cylinder pressure P1 of the first cylinder, a solid line "b" represents torque Ti generated by performing a single injection, a solid line "c" represents torque Tc generated by a compression stroke in a next cylinder, in which the injection is performed next, a solid line "d" represents a fluctuation δi of the engine rotation speed ω caused by the single injection on the basis of the engine rotation speed ω0 at a time point t1, a solid line "e" represents a fluctuation δc of the engine rotation speed ω caused by the compression stroke in the next cylinder on the basis of the engine rotation speed ω0 at the time point t1, and a solid line "f" or a broken line "f'" represents the engine rotation speed ω.

The injected fuel is combusted to generate heat, and the heat increases the cylinder pressure. Thus, the crankshaft is rotated through a piston and a connecting rod. Therefore, it can be estimated that the torque generated by the fuel injection is continuously applied to the crankshaft until the increased cylinder pressure decreases to a level provided in the case where the injection is not performed.

If the single injection is performed, the cylinder pressure P1 of the first cylinder is increased from the pressure shown by the broken line "a'" to the pressure shown by the solid line "a" in FIG. 6. The injected fuel is ignited at the time point t10 and an exhaust valve opens at a time point t12. If the rotation speed ω is measured at the ATDC 90° CA (for instance, at the time point t11), the rotation speed ω is measured before the torque corresponding to a partial pressure shown by an area Sp2 in FIG. 6 out of the increase in the cylinder pressure shown by areas Sp1, Sp2 contributes to the increase of the rotation speed ω.

Therefore, if the rotation speed ωc measured at the ATDC 90° CA is compared with the rotation speed ωt measured at the TDC, the rotation speed fluctuation δi caused by the injection cannot be measured accurately. It is because all of the energy generated by combusting the injected fuel has not yet contribute to the rotation of the crankshaft. As a result, there is a problem that the quantity of the actually injected fuel (or the torque Ti generated by the injection) cannot be estimated accurately.

Moreover, the rotation speed fluctuation δ measured by the rotation speed sensor is affected by the compression in the next cylinder, in which the injection is performed next. Therefore, only the value provided by subtracting the rotation speed fluctuation δc caused by the compression in the next cylinder from the rotation speed fluctuation δi caused by the injection can be measured. Actually, the difference δa between the rotation speed ωc and the rotation speed ωt corresponds to a value provided by subtracting the rotation speed fluctuation δam caused by the compression in the next cylinder from the rotation speed fluctuation δap caused by the injection. Therefore, even if the same injection is performed (or even if the rotation speed fluctuation δap caused by the injection is the same), the variations in the rotation speed fluctuation δam caused by the compression in the next cylinder affect the rotation speed fluctuation δa to be measured. As a result, learning accuracy of the injection quantity will be deteriorated.

Even if the rotation speed fluctuation δam caused by the compression in the next cylinder is added to the difference δa between the rotation speed ωc and the rotation speed ωt, the rotation speed fluctuation δap corresponding to the rotation speed ω on the rise due to the injection is measured. As a result, the rotation speed fluctuation δi caused by the injection cannot be measured accurately.

SUMMARY OF THE INVENTION

It is therefore an object of the present invention to provide an injection control system of an internal combustion engine capable of accurately measuring a rotation speed fluctuation of the engine caused by a single injection and of performing a learning operation highly accurately by eliminating influence of a rotation speed fluctuation caused by compression in a next cylinder.

According to an aspect of the present invention, an injection control system of an internal combustion engine includes measuring means for receiving a rotation speed of the engine sensed by a rotation speed sensor as an engine rotation speed and for measuring a rotation speed fluctuation of the engine caused by a single injection based on the engine rotation speed. The control system calculates a correction value for increasing or decreasing a command injection quantity corresponding to the single injection based on the rotation speed fluctuation of the engine, and corrects the command injection quantity in accordance with the correction value. The measuring means receives the engine rotation speed measured by the rotation speed sensor in a period from a time point when an exhaust valve opens to a time point when a top dead center of a next cylinder is detected and measures the rotation speed fluctuation based on the engine rotation speed.

In the above structure, the engine rotation speed sensed by the rotation speed sensor is inputted after the cylinder pressure increased by the single injection decreases to substantially the same level as a cylinder pressure provided when the single injection is not performed, or after torque generated by the single injection completes its work. The rotation speed fluctuation is measured based on the engine rotation speed. Therefore, the increase in the rotation speed (the rotation speed fluctuation) caused by the single injection can be measured accurately.

According to another aspect of the present invention, the measuring means includes estimating means for estimating a rotation speed fluctuation of the engine caused by a compression stroke in the next cylinder as a rotation speed fluctuation accompanying the compression stroke when the single injection is performed. The measuring means calculates a difference between a rotation speed provided before the single injection and a rotation speed provided after the single injection as an actual rotation speed fluctuation, based on the engine rotation speeds sensed by the rotation speed sensor. The measuring means measures the rotation speed fluctuation of the engine caused by the single injection based on the actual rotation speed fluctuation and the rotation speed fluctuation accompanying the compression stroke.

For instance, an engine rotation speed ω3 is measured between a phase t1 (timing t1) and an end phase of the expansion stroke of the first cylinder as shown in FIG. 6. Then, a locus of the engine rotation speed, which will be provided automatically when the single injection is not performed, is estimated. A rotation speed ω'3 on the estimated locus is measured at the same crank angle as the crank angle where the rotation speed ω3 is measured. A difference between the rotation speed ω3 and the rotation speed ω'3 represents the rotation speed fluctuation δi of the engine caused by the single injection.

Thus, when the single injection is performed, the rotation speed fluctuation δc of the engine caused by the compression stroke in the next cylinder is estimated, and the influence of the rotation speed fluctuation accompanying the compression stroke in the next cylinder is eliminated. As a result, the rotation speed fluctuation δi of the engine caused by the single injection can be measured more accurately.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
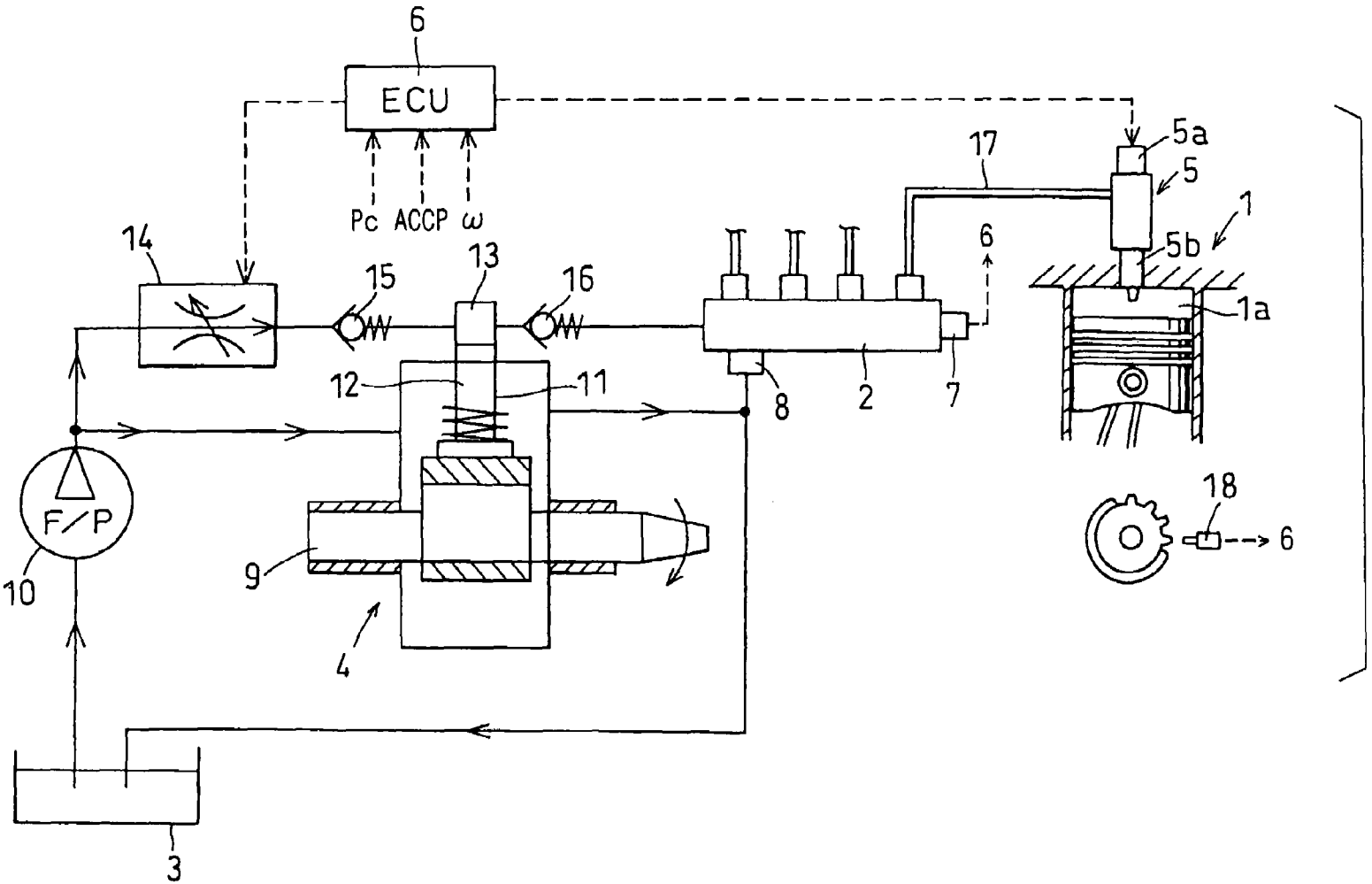
FIG. 1 is a schematic diagram showing a control system of a diesel engine according to a first embodiment of the present invention.

Referring to FIG. 1, a control system of an internal combustion engine according to a first embodiment of the present invention is illustrated. The engine of the present embodiment is a four-cylinder diesel engine 1 and has an accumulation type fuel injection system.

As shown in FIG. 1, the fuel injection system includes a common rail 2, a fuel pump 4, injectors 5 and an electronic control unit (ECU) 6. The common rail 2 accumulates high-pressure fuel. The fuel pump 4 pressurizes fuel, which is drawn from a fuel tank 3, and supplies the fuel to the common rail 2. The injectors 5 inject the high-pressure fuel, which is supplied from the common rail 2, into cylinders (combustion chambers 1*a*) of the engine 1. The ECU 6 electronically controls the system.

The ECU 6 sets a target value of a rail pressure PC of the common rail 2 (a pressure of the fuel accumulated in the common rail 2). The common rail 2 accumulates the high-pressure fuel, which is supplied from the fuel pump 4, to the target value. A pressure sensor 7 and a pressure limiter 8 are attached to the common rail 2. The pressure sensor 7 senses the rail pressure Pc and outputs the rail pressure Pc to the ECU 6. The pressure limiter 8 limits the rail pressure Pc so that the rail pressure Pc does not exceed a predetermined upper limit value.

The fuel pump 4 has a camshaft 9, a feed pump 10, a plunger 12 and an electromagnetic flow control valve 14. The camshaft 9 is driven and rotated by the engine 1. The feed pump 10 is driven by the camshaft 9 and draws the fuel from the fuel tank 3. The plunger 12 reciprocates in a cylinder 11 in synchronization with the rotation of the camshaft 9. The electromagnetic flow control valve 14 regulates a quantity of the fuel introduced from the feed pump 10 into a pressurizing chamber 13 provided inside the cylinder 11.

In the fuel pump 4, when the plunger 12 moves from a top dead center to a bottom dead center in the cylinder 11, a quantity of the fuel discharged from the feed pump 10 is regulated by the electromagnetic flow control valve 14, and the fuel opens a suction valve 15, and the fuel is drawn into the pressurizing chamber 13. Then, when the plunger 12 moves from the bottom dead center to the top dead center in the cylinder 11, the plunger 12 pressurizes the fuel in the pressurizing chamber 13. Thus, the fuel opens a discharge valve 16 from the pressurizing chamber 13 side and is pressure-fed to the common rail 2.

The injectors 5 are mounted to the respective cylinders of the engine 1 and are connected to the common rail 2 through high-pressure pipes 17. Each injector 5 has an electromagnetic valve 5*a*, which operates responsive to a command outputted from the ECU 6, and a nozzle 5*b*, which injects the fuel when the electromagnetic valve 5*a* is energized.

The electromagnetic valve 5*a* opens and closes a low-pressure passage leading from a pressure chamber, into which the high-pressure fuel is supplied from the common rail 2, to a low-pressure side. The electromagnetic valve 5*a* opens the low-pressure passage when energized, and closes the low-pressure passage when deenergized.

The nozzle 5*b* incorporates a needle for opening or closing an injection hole. The fuel pressure in the pressure chamber biases the needle in a valve closing direction (a direction for closing the injection hole). If the electromagnetic valve 5*a* is energized and opens the low-pressure passage, the fuel pressure in the pressure chamber decreases. Accordingly, the needle lifts in the nozzle 5*b* and opens the injection hole. Thus, the nozzle 5*b* injects the high-pressure fuel, which is supplied from the common rail 2, through the injection hole. If the electromagnetic valve 5*a* is deenergized and closes the low-pressure passage, the fuel pressure in the pressure chamber increases. Accordingly, the needle descends in the nozzle 5*b* and closes the injection hole. Thus, the injection is ended.

The ECU 6 is connected with a rotation speed sensor 18 for sensing an engine rotation speed (a rotation number per minute) ω, an accelerator position sensor for sensing an accelerator position ACCP (an engine load), and the pressure sensor 7 for sensing the rail pressure Pc. The ECU 6 calculates the target value of the rail pressure Pc of the common rail 2 and injection timing and an injection quantity suitable for the operating state of the engine 1 based on the information measured by the sensors. The ECU 6 electronically controls the electromagnetic flow control valve 14 of the fuel pump 4 and the electromagnetic valves 5*a* of the injectors 5 based on the result of the calculation.

In order to improve accuracy of a minute quantity injection such as a pilot injection performed before a main injection, the ECU 6 performs an injection quantity learning operation explained below.

In the injection quantity learning operation, an error between a command injection quantity (an injection command pulse) Q corresponding to the pilot injection and a quantity of the fuel actually injected by the injector 5 (an actual injection quantity) responsive to the command injection quantity Q is measured. Then, the command injection quantity Q is corrected in accordance with the error.

Next, processing steps of the injection quantity learning operation performed by the ECU 6 will be explained based on a flowchart shown in FIG. 2.

First, in Step S10, it is determined whether a learning condition for performing the injection quantity learning operation is established or not. The learning condition is established at least when the engine 1 is in a no-injection state, in which the command injection quantity Q outputted to the injector 5 is zero or under, and a predetermined rail pressure is maintained. For instance, the engine 1 is brought to the no-injection state if the fuel supply is suspended when a position of a shift lever is changed or when a vehicle is decelerated. If the result of the determination in Step S10 is "YES", the processing proceeds to Step S20. If the result of the determination in Step S10 is "NO", the processing is ended.

Figure 6:
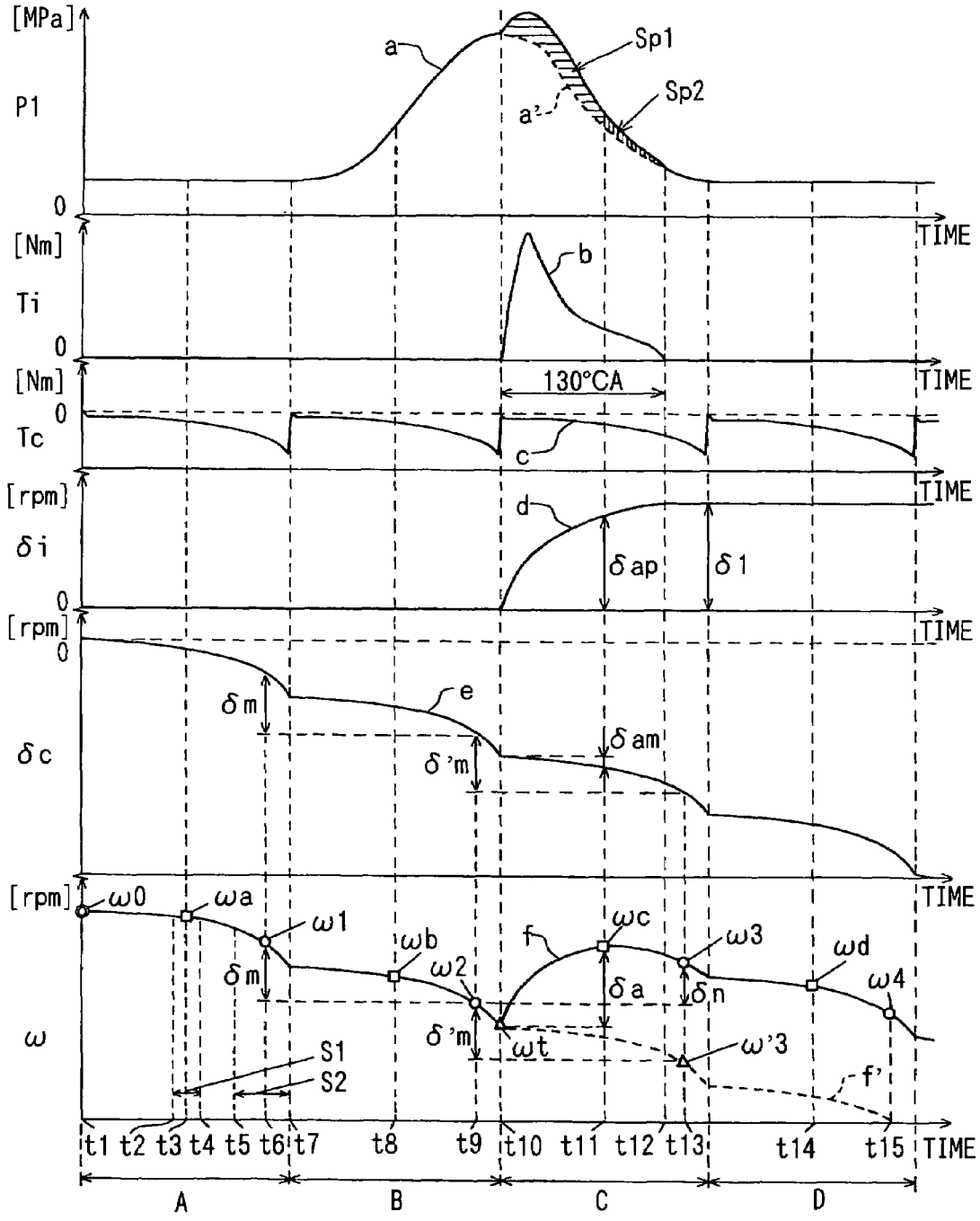
FIG. 6 is a time chart showing an operating state of an internal combustion engine.

In Step S20, a single injection for the injection quantity learning operation is performed in a specific cylinder of the engine 1 (for instance, in a first cylinder as shown in FIG. 6). The single injection is performed immediately before the TDC so that the injected fuel is ignited near the TDC of the specific cylinder. The quantity of the fuel injected in the single injection corresponds to a quantity of the fuel injected in a pilot injection.

Then, in Step S30, a characteristic value (a torque proportional value) Tp proportional to engine torque (generated torque) Ti generated by performing the single injection is calculated.

Then, in Step S40, it is determined whether the processing of Step S20 and Step S30 is performed under the aimed learning condition. In step S40, it is determined whether the learning condition presented in Step S10 has been maintained without resuming the injection or changing the rail pressure Pc while the characteristic value Tp is measured. If the result of the determination in Step S40 is "YES", the processing proceeds to Step S50. If the result of the determination in Step S40 is "NO", the processing proceeds to Step S60.

In Step S50, the characteristic value Tp measured in Step S30 is stored in a memory.

In Step S60, the characteristic value Tp measured in Step S30 is abandoned and the processing is ended.

In Step S70, a correction value C is calculated from the characteristic value Tp stored in the memory.

In Step S80, the command injection quantity Q outputted to the injector 5 is corrected in accordance with the correction value C calculated in Step S70.

Next, a method of calculating the characteristic value Tp performed in Step S30 of the flowchart shown in FIG. 2 will be explained based on a flowchart shown in FIG. 3.

First, in Step S31, the signal of the rotation speed sensor 18 is inputted and the engine rotation speed ω is measured. In the case of the four-cylinder engine 1 of the present embodiment, the engine rotation speed ω is measured four times (once for each-cylinder), or the rotation speeds ω1, ω2, ω3, ω4 are measured sequentially in that order, while the crankshaft rotates twice through the crank angle of 720° as shown by the solid line "f" in FIG. 6.

The engine rotation speed ω is measured in a measuring period S2 from a time point t5 when the exhaust valve opens to a time point t7 when the TDC of the next cylinder is detected as shown in FIG. 6. The rotation speed measured in the measuring period S2 is defined as the engine rotation speed ω of the specific cylinder. The valve opening crank angle for opening the exhaust valve is set at the ATDC 130° CA.

The engine rotation speeds ω1, ω2, ω3, ω4 are respectively measured at time points t6, t9, t13, t15 shown in FIG. 6. For instance, the engine rotation speed ω1 at the time point t6 is calculated from the period from the valve opening timing t5 of the exhaust valve to the timing t7 when the TDC of the next cylinder is detected.

In Step S32, the rotation speed fluctuations δi of the respective cylinders are calculated after the single injection is performed, and then, an average δx of the rotation speed fluctuations δi of the entire cylinders is calculated.

A difference between an estimated engine rotation speed ω' in the case where the single injection is not performed and the engine rotation speed ω (sensed by the rotation speed sensor 18), which is increased by performing the single injection, is calculated as the rotation speed fluctuation δi. For instance, in FIG. 6, a difference between the rotation speed ω3 and an estimated rotation speed ω'3 is calculated as the rotation speed fluctuation δ1 at the time immediately after the single injection. The broken line "f" in FIG. 6 represents the estimated engine rotation speed ω in the case where the single injection is not performed.

In Step S33, the torque proportional value Tp is calculated by multiplying the average δx calculated in Step S32 by an engine rotation speed ωt at the time when the single injection is performed. The torque proportional value Tp is proportional to the torque Ti of the engine 1 generated by the single injection. More specifically, the torque Ti generated by the engine 1 is calculated based on a following equation (1). Therefore, the torque proportional value Tp, which is the product of the average δx and the rotation speed ωt is proportional to the torque Ti. In the equation (1), K represents a proportionality factor.

$$Ti=K\cdot\delta x\cdot\omega t, \quad (1)$$

In the present embodiment, the engine rotation speed ω is measured in the measuring period from the time point when the exhaust valve opens (for instance, a time point t12) to the time point when the TDC of the next cylinder is detected. Therefore, the engine rotation speed ω3 at the time immediately after the single injection is measured after the cylinder pressure P1 increased by the single injection as shown by the solid line "a" decreases to substantially the same level as the cylinder pressure P1 provided when the single injection is not performed as shown by the broken line "a'" in FIG. 6. More specifically, the engine rotation speed ω3 is measured after the time point t12, by which the entire torque Ti generated by the increase in the cylinder pressure caused by the single injection as shown by areas Sp1, Sp2, is converted into the increase in the rotation speed ω. As a result, the rotation speed fluctuation δ1 shown in FIG. 6, or the increase in the rotation speed ω corresponding to the torque Ti, which is generated by the single injection, can be measured accurately.

Next, a method of calculating the rotation speed fluctuation δi in Step S32 of the flowchart shown in FIG. 3 will be explained in detail.

The rotation speed fluctuation δi (for instance, the fluctuation δ1 shown in FIG. 6) cannot be directly measured by the rotation speed sensor 18. Only a difference δn between the rotation speed ω2 and the rotation speed ω3 can be measured, for instance. However, the difference δn is affected by a rotation speed fluctuation δc (δ'm) caused by the compression stroke in the next cylinder (the third cylinder, in FIG. 6), in addition to the rotation speed fluctuation δi caused by the injection. Therefore, the rotation speed fluctuation δ'm caused by the compression stroke in the next cylinder is estimated and is added to the difference δn between the rotation speeds ω2, ω3, which are measured by the rotation speed sensor 18 before and after the single injection. Thus, the rotation speed fluctuation δ1 (δi) caused by the injection alone can be calculated.

The rotation speed ω'3 in the case where the single injection is not performed can be estimated from the rotation speed fluctuation δ'm caused by the compression stroke and the rotation speed ω2 shown in FIG. 6. Therefore, a difference between the estimated rotation speed ω' in the case where the single injection is not performed and the engine rotation speed ω measured by the rotation speed sensor 18 can be calculated as the rotation speed fluctuation δi in Step S32.

The rotation speed fluctuation δ'm caused by the compression stroke in the next cylinder can be easily estimated from the rotation speed fluctuation δc provided when the engine 1 is in the no-injection state, or when the learning condition is established. More specifically, when the engine 1 is in the no-injection state, the rotation speed fluctuation δc accompanying the compression stroke in the next cylinder decreases substantially uniformly as shown by the solid line "e" in FIG. 6. Therefore, a difference δm between the engine rotation speeds ω1, ω2 measured before the single injection is calculated under a condition that the learning condition is established, and the rotation speed fluctuation δ'm accompanying the compression stroke in the next cylinder is estimated from the difference δm.

Thus, the influence of the rotation speed fluctuation δc caused by the compression in the next cylinder can be eliminated. As a result, the injection quantity learning operation can be performed highly accurately.

Figure 2:
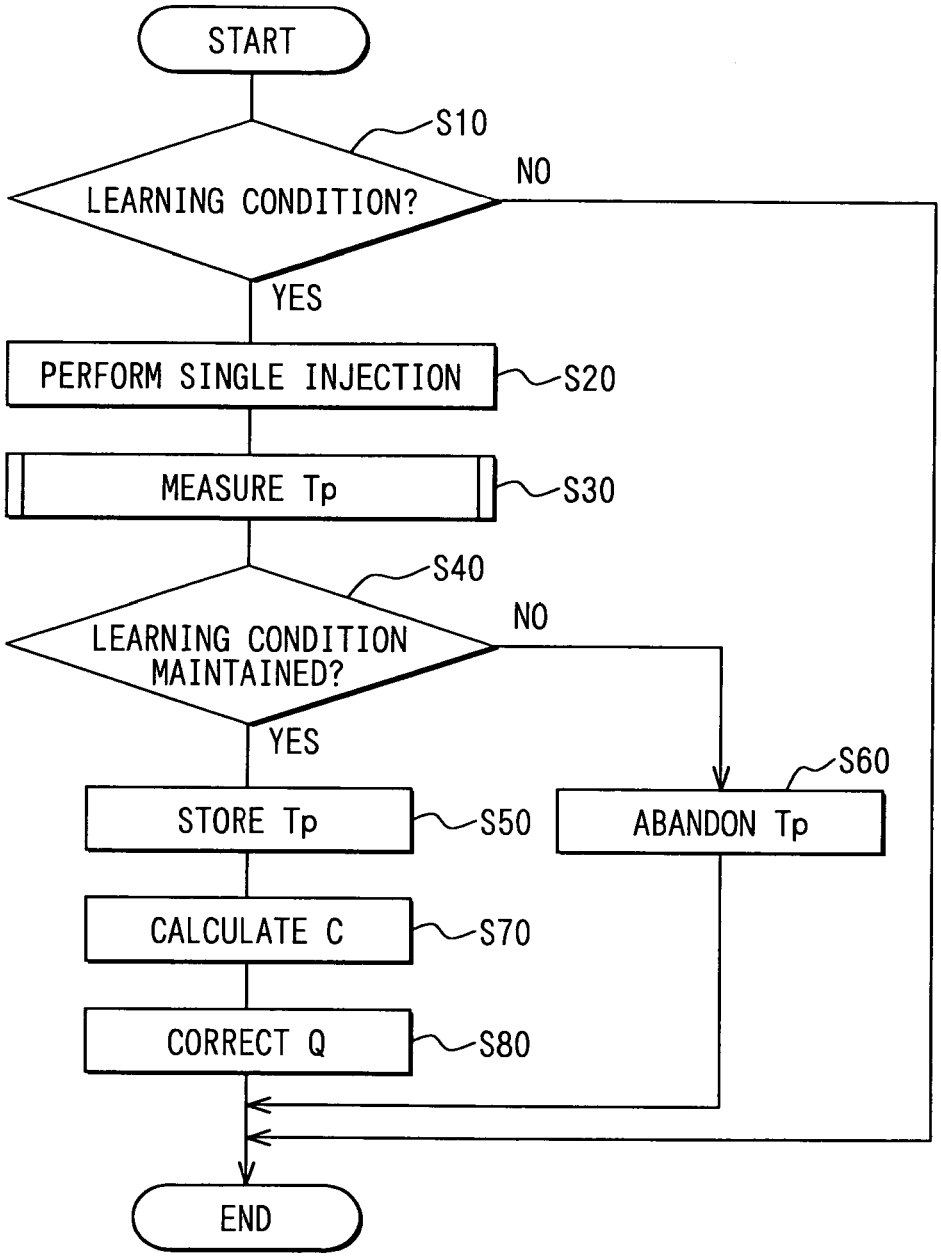
FIG. 2 is a flowchart showing an injection quantity learning operation performed by an ECU of the control system according to the first embodiment.
Figure 3:
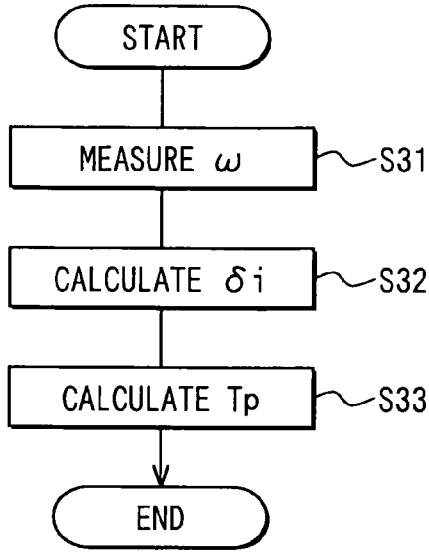
FIG. 3 is a flowchart showing a calculating method of a torque proportional value performed by the ECU of the control system according to the first embodiment.

In Step S70 of the flowchart shown in FIG. 2, the correction value C may be calculated by estimating the actual injection quantity from the generated torque Ti of the engine 1, which is calculated from the torque proportional value Tp, and by calculating a difference between the actual injection quantity and the command injection quantity Q corresponding to the single injection. Alternatively, the correction value C may be calculated based on a difference between the rotation speed fluctuation δi generated by the single injection and a target value of the rotation speed fluctuation δi. The target value of the rotation speed fluctuation δi may be stored in a map in accordance with the command injection quantity Q, in advance. Alternatively, the correction value C may be calculated based on a difference between injection pulse width corresponding to the actual injection quantity of the single injection and injection pulse width corresponding to the command injection quantity Q.

(Second Embodiment)

Next, a method of calculating the torque proportional value (the characteristic value) Tp performed by an ECU 6 according to a second embodiment of the present invention will be explained based on FIGS. 4 and 5.

Figure 4:
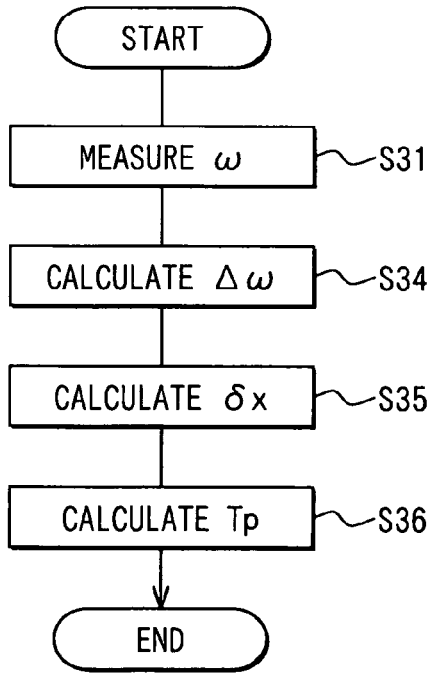
FIG. 4 is a flowchart showing a calculating method of a torque proportional value performed by an ECU of a control system of an internal combustion engine according to a second embodiment of the present invention.
Figure 5:
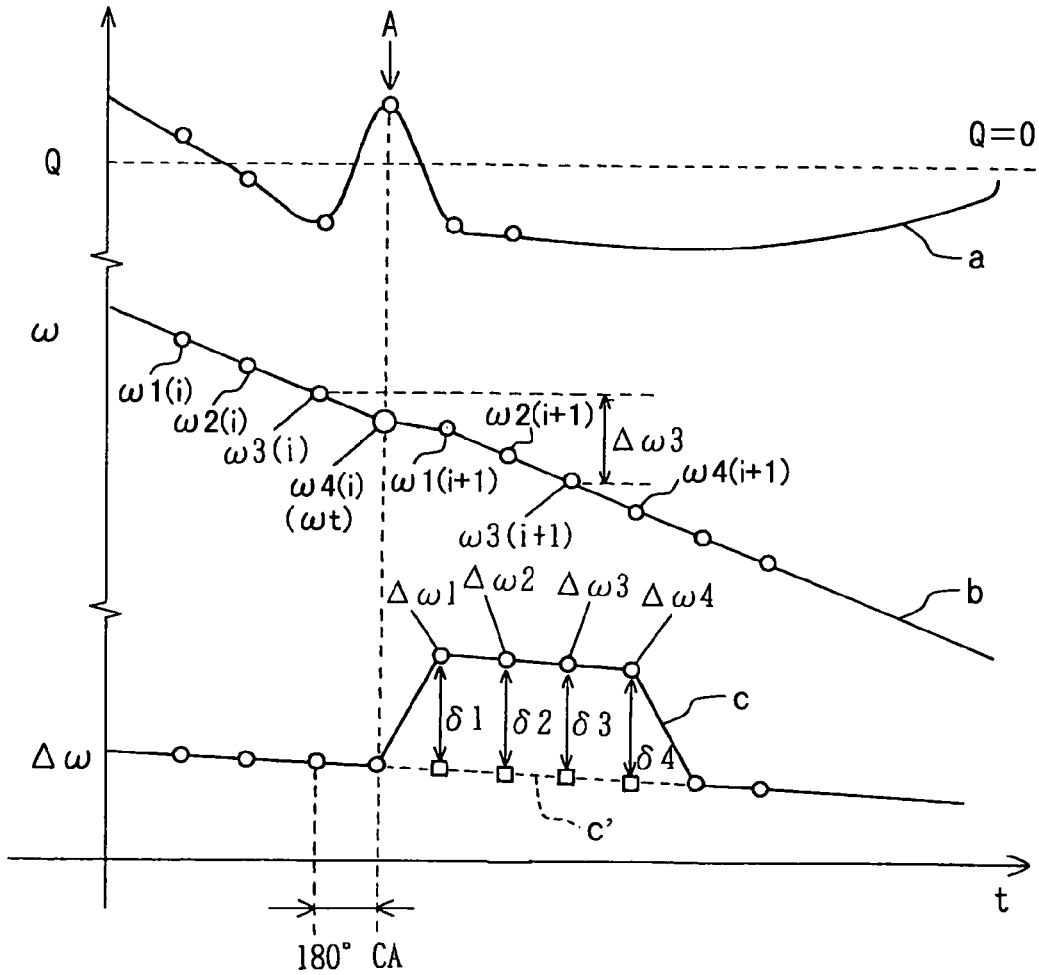
FIG. 5 is a time chart showing an injection quantity learning operation performed by the ECU of the control system according to the second embodiment.

First, in Step S31 of a flowchart shown in FIG. 4, the signal of the rotation speed sensor 18 is inputted and the engine rotation speed ω is measured. The engine rotation speed ω is measured in a period from the time point when the exhaust valve opens to the time point when the TDC of the next cylinder is detected, like the first embodiment.

Then, in Step S34, a rotation speed difference Δω is calculated for each cylinder from the engine rotation speeds ω, which are measured before and after the single injection respectively. In the case of the third cylinder, a difference Δω3 between the rotation speed ω3(i) and the next rotation speed ω3(i+1) is calculated as shown in FIG. 5. The single injection is performed at a time point "A" in FIG. 5.

Then, in Step S35, the rotation speed increases δ1, δ2, δ3, δ4 of the respective cylinders caused by the single injection are calculated, and an average δx of the rotation speed increases δ1, δ2, δ3, δ4 is calculated. A difference between the rotation speed difference Δω calculated in Step S34 and an estimated rotation speed difference Δω in the case where the single injection is not performed is calculated as the rotation speed increase δ. The rotation speed difference Δω decreases monotonically when the single injection is not performed as shown by a broken line "c'" in FIG. 5. Therefore, the rotation speed difference Δω in the case where the injection is not performed can be easily estimated from the rotation speed difference Δω provided before the single injection, or from the rotation speed differences Δω provided before and after the single injection.

Then, in Step S36, the torque proportional value Tp is calculated by multiplying the average δx calculated in Step S35 by the engine rotation speed ωt (ω4(i), in the present embodiment) at the time when the single injection is performed. The torque proportional value Tp is proportional to the torque Ti of the engine 1 generated by the single injection.

(Modifications)

In the first embodiment, the injection quantity learning operation of the pilot injection is performed. Alternatively, the present invention may be applied to an injection quantity learning operation of any one of a normal injection (an injection performed only once in one combustion stroke of one cylinder) without the pilot injection, a main injection performed after the pilot injection, and an after injection performed after the main injection.

In the first embodiment, the average δx of the rotation speed fluctuations δ1, δ2, δ3, δ4 calculated for each cylinder is used to calculate the torque proportional value Tp. Instead of the average δx, the rotation speed fluctuation δi calculated in one cylinder may be used to calculate the torque proportional value Tp. Likewise, in the second embodiment, the rotation speed increase δ calculated in one cylinder may be used to calculate the torque proportional value Tp, instead of the average δx of the rotation speed increases δ1–δ4.

The present invention may be applied to a fuel injection system having a distribution type fuel injection pump, which includes an electromagnetic spill valve, in addition to the accumulation type (common rail type) fuel injection system.

The present invention should not be limited to the disclosed embodiments, but may be implemented in many other ways without departing from the spirit of the invention.

What is claimed is:

1. An injection control system of an internal combustion engine, the injection control system comprising:

determining means for determining whether a learning condition for performing an injection quantity learning operation is established;

commanding means for performing a single injection from an injector into a specific cylinder of the engine to perform the injection quantity learning operation when the learning condition is established;

measuring means for receiving a rotation speed of the engine sensed by a rotation speed sensor as an engine rotation speed and for measuring a rotation speed fluctuation of the engine caused by the single injection based on the engine rotation speed;

calculating means for calculating a correction value for increasing or decreasing a command injection quantity, which is outputted to the injector, based on the rotation speed fluctuation of the engine; and correcting means for correcting the command injection quantity by increasing or decreasing the command injection quantity in accordance with the correction value, wherein the measuring means receives the engine rotation speed sensed by the rotation speed sensor in a period from a time point when an exhaust valve opens to a time point when a top dead center of a next cylinder, in which an injection is performed next to the specific cylinder, is detected, and measures the rotation speed fluctuation based on the engine rotation speed.

2. The injection control system as in claim 1, wherein the measuring means includes estimating means for estimating a rotation speed fluctuation of the engine caused by a compression stroke in the next cylinder as a rotation speed fluctuation accompanying the compression stroke when the single injection is performed, the measuring means calculates a difference between the rotation speed provided before the single injection and the rotation speed provided after the single injection based on the engine rotation speeds sensed by the rotation speed sensor as an actual rotation speed fluctuation, and the measuring means measures the rotation speed fluctuation caused by the single injection based on the actual rotation speed fluctuation and the rotation speed fluctuation accompanying the compression stroke.

3. The injection control system as in claim 2, wherein the estimating means estimates the rotation speed fluctuation accompanying the compression stroke in the case where the single injection is performed based on the fluctuation of the rotation speed, which is sensed by the rotation speed sensor before the single injection is performed in a state in which the learning condition is established.

4. The injection control system as in claim 1, wherein the calculating means calculates a target value of the rotation speed fluctuation from the command injection quantity corresponding to the single injection and calculates a difference between the target value and the rotation speed fluctuation measured by the measuring means as an error, and calculates the correction value in accordance with the error.

5. The injection control system as in claim 1, wherein the calculating means calculates an actual injection quantity of the fuel actually injected in the single injection based on the rotation speed fluctuation of the engine measured by the measuring means, and calculates a difference between the actual injection quantity and the command injection quantity corresponding to the single injection as an error, and calculates the correction value in accordance with the error.

6. The injection control system as in claim 5, wherein the calculating means compares injection pulse width corresponding to the actual injection quantity with injection pulse width corresponding to the command injection quantity, and calculates the correction value in accordance with a difference between the injection pulse width corresponding to the actual injection quantity and the injection pulse width corresponding to the command injection quantity.

7. The injection control system as in claim 1, wherein the learning condition is established at least when the engine is in a no-injection state, in which the command injection quantity outputted to the injector is zero or under.

* * * * *